US006070591A

United States Patent [19]

Bryer

[11] Patent Number: 6,070,591

[45] Date of Patent: Jun. 6, 2000

[54] PORTABLE CIGAR ASHTRAY AND SAVER WITH CUTTER

[76] Inventor: Linda Bryer, P.O. Box 725, Santa Cruz County, Soquel, Calif. 95073

[21] Appl. No.: 09/113,451

[22] Filed: Jul. 10, 1998

Related U.S. Application Data

[60] Provisional application No. 60/052,255, Jul. 11, 1997.

[51] Int. Cl.[7] ..... A24F 13/24; A24F 19/12; A24F 15/08

[52] U.S. Cl. ..... 131/233; 131/239; 131/241; 131/242; 131/251; 206/238; 206/246; 206/261; 206/265; 206/92

[58] Field of Search ..... 131/233, 238, 131/239, 240.1, 241, 242, 248, 250, 251, 253; 30/111, 113; 206/38, 238, 92, 246, 261, 265, 263, 818

[56] References Cited

U.S. PATENT DOCUMENTS

| | | | |
|---|---|---|---|
| 1,085,517 | 1/1914 | Wormser | 206/92 |
| 1,459,077 | 6/1923 | Winans | 131/233 |
| 1,472,149 | 10/1923 | Bernard | 131/234 |
| 1,646,632 | 10/1927 | Spinner | 206/242 |
| 1,651,177 | 11/1927 | Bowyer | 131/238 |
| 2,375,243 | 5/1945 | Pinkett | 131/239 |
| 2,777,569 | 1/1957 | Starke | 206/86 |
| 4,027,683 | 6/1977 | Lawbaugh | 131/235.1 |
| 5,832,934 | 11/1998 | Schmidt | 131/329 |

*Primary Examiner*—James Derrington
*Assistant Examiner*—Dionne A. Walls

[57] ABSTRACT

An improved combination portable ash receptacle and saver for cigars with an area for a cigar cutter, 20, and matches, 16, all in a hinged, two part case* consisting of a top, 2, and a bottom, 4, that shut tightly together via a built-in latch. The top portion of the latch, 6, located on the top of the case, catches firmly on the corresponding bottom part of the latch, 8, located directly beneath on the bottom half of the case. The hinge, 30, is located on the opposite side of the latch and is durable in order to accommodate frequent use. The interior of the case is divided into 6 compartments via two ribs in each half, one rib running the length of the case on the top, 24, and 34 on the bottom, and another rib dissects it perpendicularly in each half, 10 on the bottom and 26 on the top. This creates three compartments in the top portion, or lid, and three more in the bottom. The construction of the case is such that when it is closed, each compartment is fully self-contained, that is, the contents of each stays separate. The user places a partially smoked cigar in the saving compartment, 14 and 18, and then closes the case, which will then keep the cigar fresh until re-lit later on. The bottom compartments are for a molded ashtray, 12, a box of matches or breathmints, or whatever else the carrier would like to fit inside that compartment, 16, and a slender, elongated compartment into which the partially smoked or unsmoked cigar sits, 14. In the top half of the case, in the portion that aligns with and corresponds to the ashtray on the bottom, is a compartment, 20, that contains an inset magnet, 32, which serves the purpose of fastening a cigar cutter with a stainless steel blade, 38, to it so as to keep it in place. Adjacent to that in the top is another compartment, 22, and the long, thin compartment in the top, 18, corresponds exactly to the one in the bottom, which is for saving the cigar.

1 Claim, 4 Drawing Sheets

PORTABLE CIGAR ASHTRAY AND SAVER WITH CUTTER

CROSS REFERENCE TO RELATED APPLICATIONS

This application claims the benefit of U.S. Provisional Application No. 60/052,255, filed on Jul. 11, 1997.

The name of this invention has been granted status as a Registered Trademark: CI-GARAGE®, Serial # 75/319, 081, Published May 5, 1998, belonging to this inventor, Linda Bryer, and will herein be referred to as the "case".

BACKGROUND

1. Field of Invention

This invention relates to an improved combination ash receptacle and saver for cigars, with the added feature of a cigar cutter, and particularly relates to an especially constructed device which can readily be carried in an individual's pocket or purse and which device, when in open position, will support a lit or unlit cigar or the like in a convenient position for the user, and will serve as an individual ashtray for receiving ashes and, when closed, will retain the ashes and/or match butts, as well as save a cigar portion therein, and be sealed tightly and be safe to be carried.

2. Discussion of Prior Art

U.S. Pat. No. 1,459,077 Cigarette Salvage Case had a limited use: only as an ashtray and as a saver only for cigarettes.

U.S. Pat. No. 2,375,243 Smoker's Appliance had limited use as well: as a combination holder for matches in a packet and for cigarette ashes.

U.S. Pat. No. 1,085,517 did not provide any means for saving the unsmoked portions of cigar or cigarettes contained therein.

U.S. Pat. No. 2,777,569 did not have the safety feature of a heat-diffusing stainless steel ashtray with 2 cigar rests molded in, and conforming into its own compartment.

U.S. Pat. No. 1,472,149 did not provide any means for including a cigar cutter in its smokers set.

OBJECTS & ADVANTAGES

The primary object of the present invention is to provide a compact container with multiple compartments, having a top hinged cover.

With a device of this kind, the smoker is provided with a convenient, portable ash receptacle so that, where no ashtrays or the like are provided, the ashes may be dropped into this receiver to be subsequently disposed of in the usual manner.

A further object of this invention is to provide a receptacle in which the ash receiver compartment will perfectly house a stainless steel ash chamber of predetermined size and shape, to prevent spilling of ashes, by providing closure in the opposite half of the case, effectively sealing the chamber so that the receptacle may be placed in a pocket with ashes that stay in that chamber.

Another object of the present invention is to provide means on the inner face of the lower chamber to support one or two lit or unlit cigars when the cover is open.

A further object of the present invention is to provide a means on the bottom chamber for retaining matches, which are included, and provide easy removability. This chamber can also be used to carry a breath product or a small lighter.

A still further object of the present invention is to provide a means on the top chamber in which a removable stainless steel-bladed cigar cutter fits in, held in place by a magnet inset in the mold itself. It lifts up and out easily for use in cutting ends of cigars, and is easily placed on top of the magnet when replacing it.

A still further object of this present invention is to provide a storage space, separate from the rest of the inner parts, wherein the unsmoked portion of a cigar can rest and remain fresh, away from any accumulated ashes.

A still further object of this present invention is to provide a pocket ashtray and cigar saver, with a removable cigar cutter, and a box of matches, of the character described that is durable, economical to manufacture, simple in construction, and both highly versatile and serviceable in use.

A further object of this invention is to provide a receptacle which may be made out of metal, plastics, wood or other suitable material, and of varying sizes to accommodate larger cigars and/or cutters and/or matches or lighters.

To the foregoing objects and others which may hereinafter appear, the invention consists of the novel construction, combination and arrangement of parts as will be more specifically referred to and illustrated in the accompanying drawing(s), but it is to be understood that changes, variations and modifications may be resorted to which fall within the scope of the invention as claimed.

Further objects and advantages of my invention will become apparent from a consideration of the drawings and ensuing description.

DRAWING FIGURES

In the accompanying drawings, forming a part of the description and wherein for the purpose of illustration, like numerals designate like parts throughout the same:

REFERENCE NUMERALS IN DRAWINGS

Figure 1:
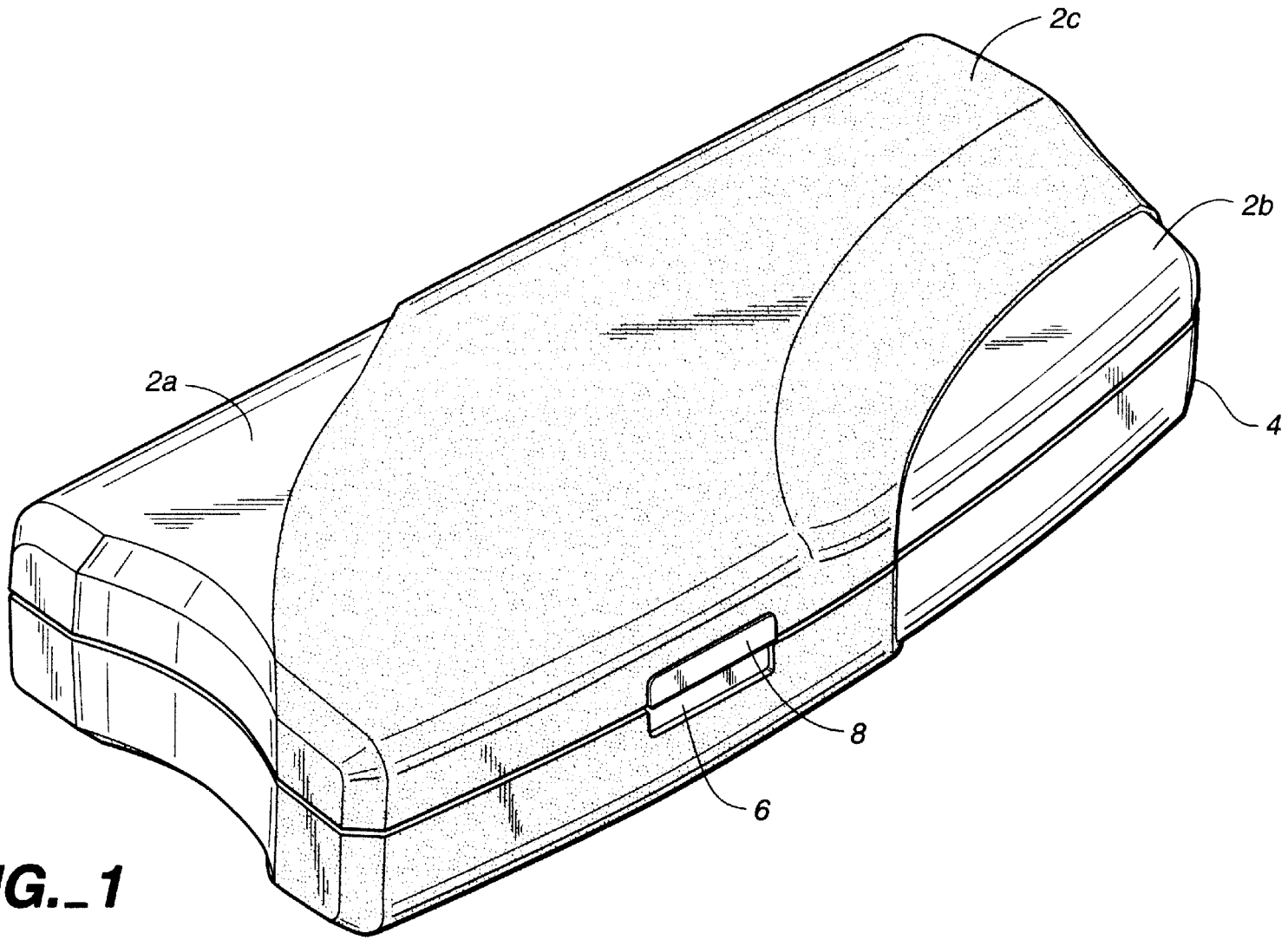
FIG. 1 is a perspective view of the Ci-Garage® case in closed position.

2*a* Top of case, glossy portion in upper left corner
2*b* Top of case, glossy portion in lower right corner
2*c* Top of case, matte/textured portion in center
4 Bottom of case
6 Latch, bottom portion
8 Latch, top portion
10 Cross rib in bottom of case with arcuate formation to accommodate a cigar rest
12 Ash receptacle compartment
14 Cigar saving compartment, bottom
16 Compartment for matches or breath product
18 Cigar saving compartment, top
20 Compartment that holds cigar cutter
22 Compartment in top
24 Dividing rib lengthwise, in top of case
26 Cross rib in top of case
28 Indent for cigar rest in ashtray
30 Hinge for both halves of case
32 Magnet inset into compartment 20

34 Dividing rib lengthwise, in bottom of case

36 Recesseed area on outside bottom of case for a label or logo or monogram

38 Cigar cutter with a blade, typically of stainless steel

SUMMARY OF INVENTION

In accordance with the present invention, a hinged carrying case which features an interior comprised of six compartments, three in each half of the case, to accommodate basic smoking accessories, a cigar cutter and matches, and a safe method to hold or save a cigar for later smoking enjoyment, all in one case that is of a size to be readily and easily portable.

DESCRIPTION: MAIN EMBODIMENT

Referring now in detail to the drawings, in FIG. 1, the numerals 2*a,* 2*b* and 2*c* represent the top half of the case, and the numeral 4 the bottom half, with the latch that has the means to close the case tight being represented by the numerals 6 and 8. Numeral 6 refers to the indented portion found on the bottom half, into which a thumb is placed; and numeral 8 represents the lip found on the top half, which is then pushed upward to open the case, and conversely, pressed down upon to seal it shut. Numerals 2*a* and 2*b* refer to the glossy portions of the top half of the case, with 2*c* representing the textured portion.

Figure 2:
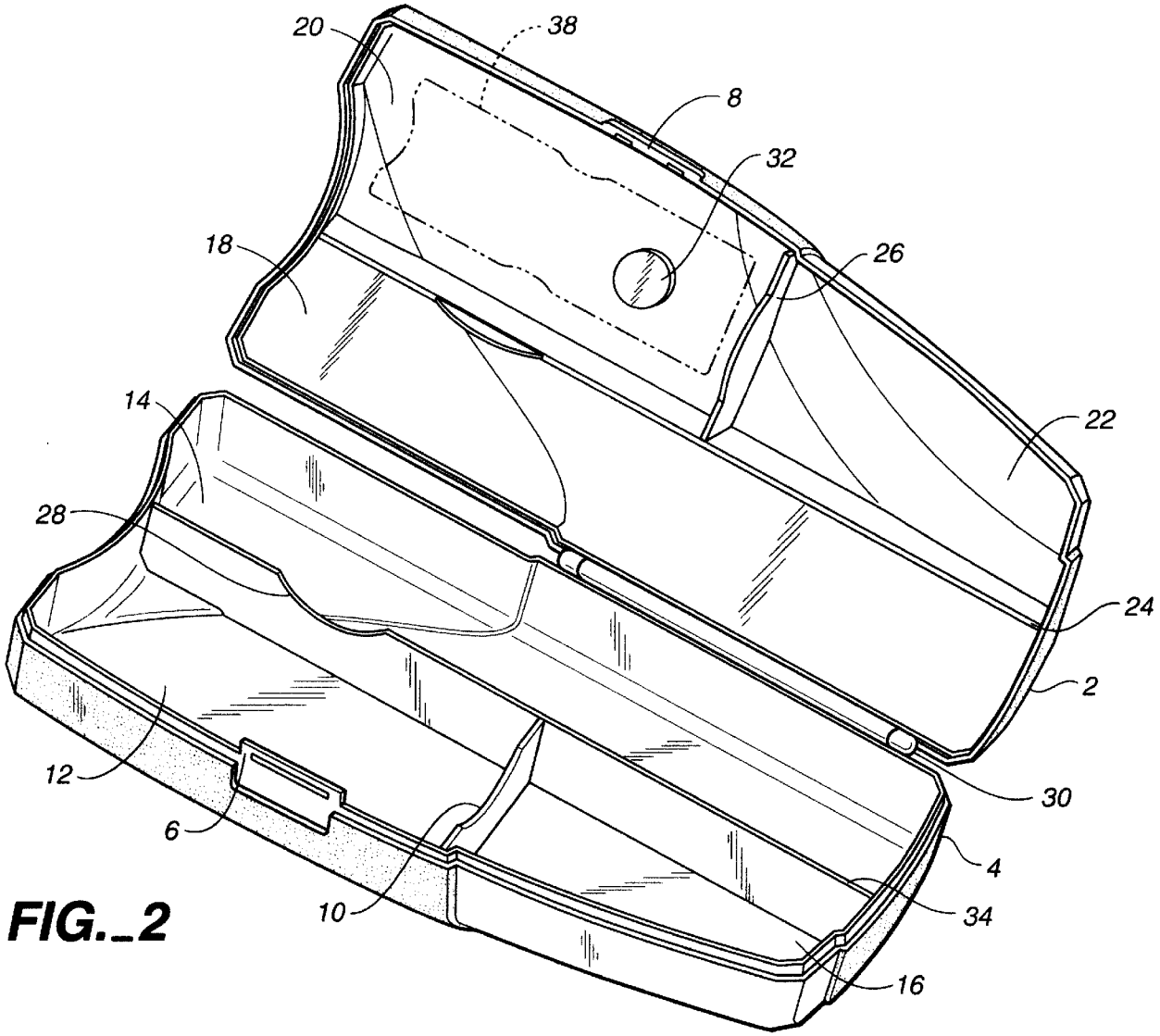
FIG. 2 is a view of the same, in open position.

In FIG. 2, the two primary halves of the case are each separated into three compartments; in the bottom half, numeral 4, it is divided by a rib running lengthwise shown at 34, and a cross rib of arcuate formation shown at 10. The three compartments created by numerals 34 and 10 are the uniquely-shaped ash receptacle compartment, shown as numeral 12, the elongated cigar saving compartment numeral 14, and an additional compartment 16. In the top half, numeral 2, the three compartments there are those which correspond to the numerals 18, 20 and 22, respectively: the cigar saving compartment top numeral 18, the compartment opposite the ash receptacle, numeral 20, which houses the cutter via the inset magnet, shown as numeral 32, and the top portion of the additional compartment, numeral 22. These three compartments are created by the corresponding lengthwise dividing rib, shown as numeral 24, and the corresponding reverse arcuate formation, numeral 26. The hinge by which the top and bottom are attached is numeral 30.

Figure 3:
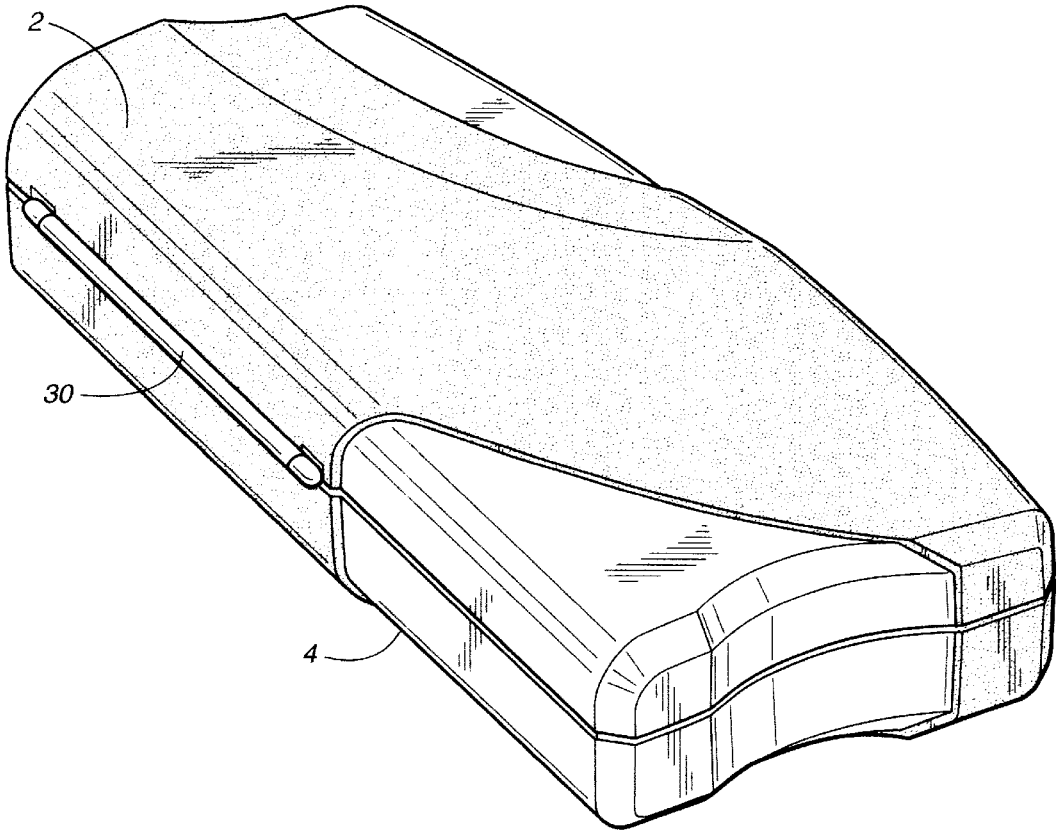
FIG. 3 is a longitudinal cross-sectional view of the same when closed, seen from the side of the case and showing the hinge that holds it together.

FIG. 3 shows the hinge and the larger side wherein the cigar or cigar butt is saved.

Figure 4:
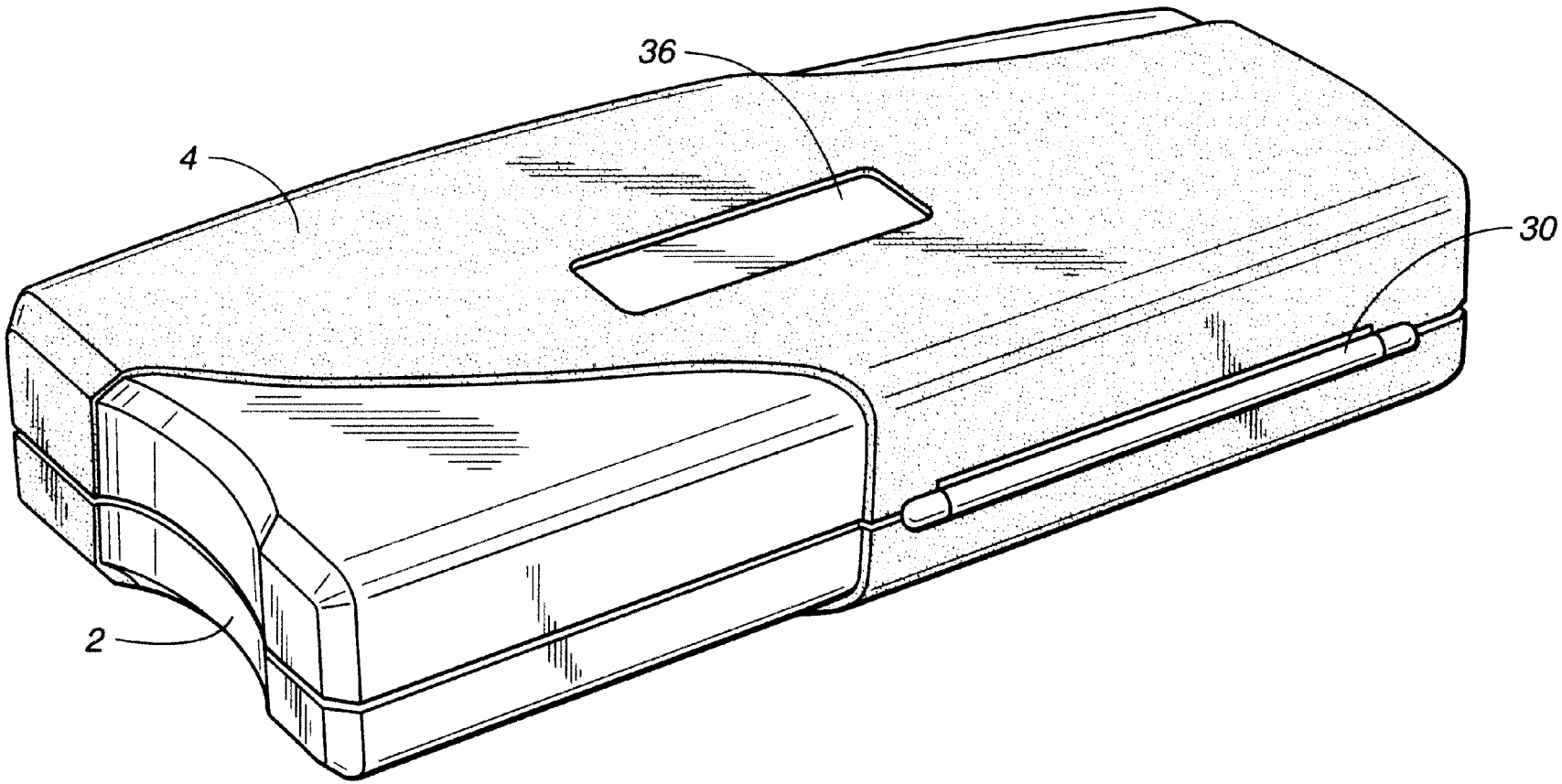
FIG. 4 is a view of the case when closed, as seen from the bottom, illustrating a recessed area molded into the bottom of the case for a label or logo or monogram.

FIG. 4 shows the same side, viewed from the bottom of the case, wherein a recessed area is molded into the case so as to accommodate various methods of personalization, such as a label or a logo or a monogram.

Operation: Main Embodiment

In operation, the case is opened and a burning cigar is placed to rest on the groove created to accommodate it, shown as numeral 10, with the lit end extending over compartment 12. During operation, the stainless steel material which gets placed into compartment 12 will accommodate ashes dumped into it.

When the case is closed, the cigar will self-extinguish due to lack of air. The ashes will remain in compartment 12 until emptied by hand. The case is then placed in the user's pocket, where the cigar butt will remain unlit while the rest of the cigar will be kept fresh in its cigar-saving compartment, numerals 14 and 18.

When it is desired to re-light the cigar, the case is opened, the cigar taken out and re-lit, utilizing the matches in compartment numeral 16.

An additional rest for the cigar, or to accommodate yet another cigar, is shown as numeral 28.

The stainless steel-bladed cigar cutter is held in place via a magnet, numeral 32, that sits in its built-in area in compartment numeral 20, and as such, makes the cutter easily removable for use. Once the cigar has been cut, the case remains open and the cutter is placed back on top of the magnet, securing it safely back in the case.

Description and Operation: Alternative Embodiments

Because of the large variety in the sizes and shapes of cigars, additional embodiments have been considered here which will prove very useful in accommodating that variety.

- Size of case is larger so that two or three cigars can fit neatly into place, enlarging the compartments shown as numerals 14 and 18.
- Size of case is larger so as to accommodate a longer cigar. This case is ideal for an unsmoked Robusto (between 5" and 5½" in length) or a partially smoked cigar that has been smoked down to that length. A longer case will accommodate Churchills, Coronas and other bigger cigars.
- Humidor is added to keep unsmoked cigars fresh in compartments 16 or 22.
- Size of case is smaller so that it may accommodate cigarettes.
- Size of case is larger to accommodate cigar lighter in an enlarged compartment, numeral 16.
- Size of case is smaller and more delicate, so that it looks more feminine and can accommodate small cigars or cigarettes.

No other invention before this has taken into consideration so many of the needs of the cigar smoker: ashtray, cigar saver, a place for matches or breath product, plus the removable, easily-attached cigar cutter, and then made them all available in one handy, easy to use, easy to carry, attractive portable case, sized to fit neatly into a pocket, golfbag or sportsbag, briefcase or purse.

From the foregoing, it will be seen that a simple, easily manufactured combination ash receptacle, and cigar saver, and cigar cutter with additional compartments for matches or breath mints has been provided. This invention affords convenient means for holding ashes and saving cigars or both when open, and for enclosing the same when not in use, and for the cutting of cigars when desired, and the lighting of cigars, all in one handy, portable case.

Conclusion, Ramifications and Scope

Thus the reader will be able to see that this carrying case for cigars provides a highly reliable, lightweight yet durable, convenient device that can be used by anyone who wishes to save a cigar, hold a cigar until ready to smoke it, light it with matches, and cut it with a cutter, and then take it with them.

While the above description contains many specifications, these should not be construed as limitations on the scope of this invention, but rather as an exemplification of one preferred embodiment thereof. Many other variations are possible. For example, for those who prefer to smoke larger cigars, a longer case could easily be constructed, and for those who prefer to hold two cigars, the case could easily be constructed to have two cigar saving compartments, one to hold a partially smoked cigar and the other to hold a fresh unsmoked cigar. Furthermore, this invention could easily be made in a variety of colors and in a wide variety of finishes, such as marble or tortoise shell, as well as having it be made out of hardwoods or metals, each with a different finish or patina, for aesthetic purposes and to appeal to various users.

Accordingly, the scope of the invention should be determined not by the embodiments(s) illustrated, but by the appended claims and their legal equivalents.

I claim:

1. A combination portable carrying case and cutter for cigars having a top portion and a bottom portion connected by means allowing repeated openings and closings of said top and bottom portions, said case comprising:

an ash receiving compartment in the bottom portion of said case into which a tray of heat-resistant material with a predetermined shape is positioned, said tray being easily removed for disposal of contents and replacement with another tray, an ash receiving compartment top disposed in said top portion of the case which corresponds to said ash receiving compartment in the bottom portion such that upon closure of said case, the top and bottom ash receiving compartments are aligned and wherein said ash receptacle compartment top has an inset magnet with an attached cigar cutter having a metal blade whereby the cutter is easily removable for use, a thin, elongated cigar receiving compartment in the bottom portion of the case which abuts said ash receiving compartment in said bottom portion, said cigar receiving compartment having sufficient capacity for holding unsmoked and partially smoked cigars, a thin, elongated compartment top disposed in said top portion of the case which corresponds to said cigar receiving compartment in the bottom portion such that upon closure of said case, the top and bottom cigar receiving compartments fit exactly creating a secure cigar-saving area, a match or breathmint receiving compartment in the bottom portion of the case which is adjacent to said ash receiving compartment in said bottom portion, said receiving compartment having sufficient capacity for the storage of matches or breathmints, a compartment disposed in said top portion of the case which corresponds to the match and breathmint receiving compartment in said bottom portion such that alignment is achieved upon closure of the case.

* * * * *